United States Patent [19]

Walsh

[11] Patent Number: 4,927,062

[45] Date of Patent: May 22, 1990

[54] PRECISION MICRO-LITER DROP DISPENSER

[76] Inventor: James W. Walsh, 3832 Beech Ave., Baltimore, Md. 21211

[21] Appl. No.: 247,864

[22] Filed: Sep. 22, 1988

[51] Int. Cl.[5] ..... B65D 47/18

[52] U.S. Cl. ..... 222/420; 222/211; 604/295

[58] Field of Search ..... 222/209, 211, 420, 421; 604/295; 73/864.01, 864.02

[56] References Cited

U.S. PATENT DOCUMENTS

| | | | |
|---|---|---|---|
| 1,153,810 | 9/1915 | Milward . | |
| 2,363,474 | 11/1944 | Schlesinger | 222/209 |
| 2,522,832 | 9/1950 | Loeffler | 604/295 |
| 2,540,360 | 2/1951 | Ulvild | 222/209 |
| 2,706,582 | 4/1955 | Flamm | 222/211 |
| 2,734,665 | 2/1956 | Flamm . | |
| 2,896,237 | 7/1959 | Owens et al. . | |
| 2,987,223 | 6/1961 | Armour . | |
| 3,186,450 | 6/1965 | Beall et al. | 222/209 |
| 3,233,785 | 2/1966 | Burke | 222/209 |
| 3,308,999 | 3/1967 | Darlington, Jr. . | |
| 3,788,528 | 1/1974 | Ogle | 222/209 |
| 3,921,460 | 11/1975 | Schmidlin | 73/864.02 |
| 4,030,640 | 6/1977 | Citrin et al. | 222/209 |
| 4,234,103 | 11/1980 | Strobl, Jr. et al. . | |
| 4,408,699 | 10/1983 | Stock . | |
| 4,498,609 | 2/1985 | Stock . | |

FOREIGN PATENT DOCUMENTS

| | | | |
|---|---|---|---|
| 2039964 | 2/1972 | Fed. Rep. of Germany | 222/420 |
| 2355057 | 5/1978 | Fed. Rep. of Germany | 222/420 |
| 521237 | 6/1938 | United Kingdom | 222/420 |

*Primary Examiner*—Kevin P. Shaver
*Assistant Examiner*—Steven Reiss
*Attorney, Agent, or Firm*—Cushman, Darby & Cushman

[57] ABSTRACT

The present invention provides a dropper tip suitable for dispensing small-volume droplets of fluid with a minimum drop-to-drop volumetric variation. The dropper tip includes a minimum-surface dispensing tip and a similar minimum-surface interior configuration that minimizes the surface area available at the entry port of the dispenser tip for the aggregation or adhesion of bubbles. In the preferred embodiment, the minimum-surface configuration allows for uniform drop formation at the tip whether or not the dropper is in a vertically inverted or inclined position when dispensing. The interior configuration likewise minimizes the surface area available for air bubbles to congregate or adhere and thereby minimizes the probability of an air bubble reentering the dropper tip when dispensing the second or subsequent drop. A cap effects sealing on a surface other than the tip so that repeated capping and uncapping will not degrade the minimum-surface rim.

18 Claims, 3 Drawing Sheets

FIG. 2
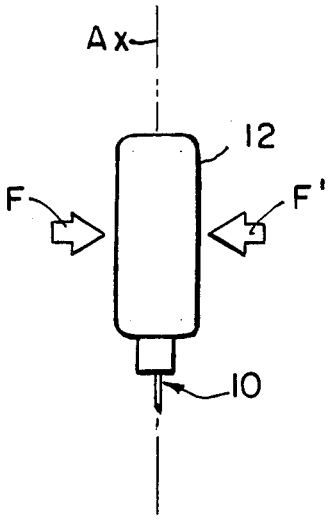
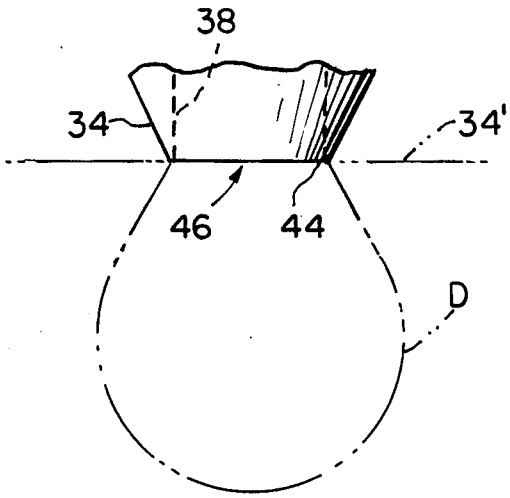
FIG. 3
FIG. 4
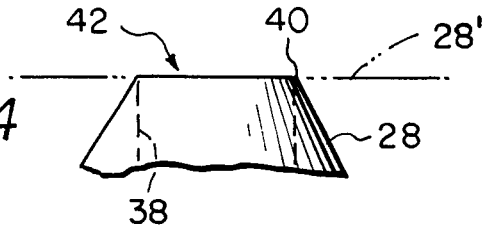

PRECISION MICRO-LITER DROP DISPENSER

CROSS REFERENCE TO RELATED APPLICATIONS

The subject matter of the present application is related to that disclosed in applicant's co-pending and commonly owned U.S. Design patent applications Ser. Nos. 100,008 entitled "Dropper Tips or Similar Articles" and 100,009 entitled "Dropper Tip or Similar Article", both filed on Sept. 23, 1987.

BACKGROUND OF THE INVENTION

The present invention relates to dropper tips and containers for dispensing of selected liquids in drop form, and, more particularly, to dropper tips, containers, and closures for dispensing liquids in drop form in less than 60 microliter volumes with precise first-drop volumes and minimum drop-to-drop volume variations.

The common dropper tip used in laboratory-type "squeeze" bottles and dispensers is typically formed from a rigid or resilient material, such as glass, plastic, or metal, and has an elongated hollow stem that terminates in a nozzle-like tip through which the liquid to be dispensed flows. Typically, the base of the dropper tip, that is, the end that is attached to the liquid-carrying container, is formed with a fitment that is pressed into or otherwise inserted into the neck portion of the plastic squeeze bottle. The squeeze bottle is typically inverted by the user and manually squeezed to dispense one or more drops through the hollow stem. In the general area of chemical and biological analysis, a number of disposable test kits have been developed that include prepackaged chemicals, reagents, and other fluids that are used to effect analysis or other tests involving the drop-wise dispensing of a fluid. When the various liquids are fully dispensed, the components of the kit are discarded. Disposable test kits represent an inexpensive and convenient manner by which tests may be effected without the need for traditional re-usable laboratory equipment. In some cases, the cost of the chemicals involved is quite high, and, in order to provide an economically feasible and disposable test kit, small volumes (i.e., 3 to 7 milliliters) of the fluid are provided in resilient plastic squeeze bottles for use by the user with volumetrically small drops dispensed from the tips, these drops typically being less than 60 microliters and often in the 12 to 50 microliter range. Where it is important to dispense precise first-drop volumes and precise second and subsequent drop volumes, any significant drop-to-drop variations in the drop volume can affect the test results, i.e., a drop-to-drop volumetric variation above a predetermined limit can cause an undesired oversupply or undersupply of the dispensed fluid.

The traditional resilient squeeze bottle has been found to have a substantial drop-to-drop volumetric variation when dispensing one or more drops under 60 microliters and particularly drops in the 12 to 50 microliter range. For example, when a squeeze bottle is initially inverted, the headspace gas in the neck portion of the bottle normally rises to the top of the liquid in the now inverted bottle. Oftentimes, one or more bubbles of the headspace gas may adhere to a surface at or adjacent the entry opening of the dropper stem. Also, it has been observed that a single headspace bubble will occupy the entire neck region of the bottle and prevent the liquid from readily entering the dispenser stem. The typical user has an empirical expectation that a first drop will be dispensed upon the application of an initial squeezing force. When one or more headspace-gas bubbles are present, the bubbles may enter the lumen of the dispensing stem to interfere with the flow of liquid through the lumen and prevent the formation of the first drop in a manner consistent with the user's expectation. In this instance, the normal response of the user is to incrementally increase the squeezing force in an attempt to drive liquid to the end of the dispensing tip to form a drop. Where the second increment of squeezing force does not produce a drop, it has been observed that most users will dramatically increase the squeezing force in an attempt to dispense a drop. Usually, this third increment of increased squeezing force is successful in expelling the entrained air in the lumen and also forces enough liquid to the end of the dropper tip to generate an unintended succession of drops. When the squeezing force is relaxed after one or more drops are dispensed, air will be aspirated through the lumen into the inverted bottle and oftentimes forms a bubble that adheres to the entry port area of the fitment. The bubble will re-enter the lumen when the next drop is dispensed thereby contributing to undesired drop-to-drop volumetric variation contributing to poor user feedback and making manual control difficult.

As can be appreciated, the ability to effect the analysis or test results using very small and precisely measured drop volumes of the fluids involved increases the economic feasibility of such disposable test kits.

SUMMARY OF THE INVENTION

In view of the above, it is a primary object of the invention, among others, to provide a dropper tip and dropper bottle combination that allows delivery of one or more droplets of a fluid having a predetermined volume.

It is another object of the present invention to provide a dropper tip and dropper tip bottle combination that provides accurate first-drop volumes as well as subsequent drop-to-drop volumetric deliveries with minimum deviations.

It is still another object of the present invention to provide a dropper tip and dispensing bottle combination in which the probability of introducing air bubbles into the lumen of the dispensing tip from the interior of the container is minimized.

It is a further object of the present invention to provide a dropper tip, squeeze bottle, and overcap combination that effectively seals the exterior opening of the dropper tip and applies a sealing force between the dropper tip fitment and the squeeze bottle.

In view of these objects, and others, the present invention provides a dropper tip suitable for dispensing one or more small-volume droplets of fluid with a minimum drop-to-drop volumetric variation and includes a base or fitment portion for insertion into the neck portion of a conventional resilient "squeeze" bottle and a hollow elongated stem that extends from the fitment and terminates with a minimum liquid-surface contact area dispensing tip. The interior end of the fitment is provided with an interiorly extending stem and a similar minimum-surface interior configuration that minimizes the surface area available at the entry port of the lumen for the adhesion of bubbles. An overcap seals the dispensing tip on a surface other than the minimum liquid-surface contract area of the dispensing tip and also serves to apply a sealing force between the fitment and the squeeze bottle.

In the preferred embodiment, the minimum-surface configuration is provided by a frusto-conical surface of revolution that terminates in a circular rim that minimizes the liquid contact surface area and which allows for uniform drop formation at the rim. The interior configuration is likewise formed with a frusto-conical surface to define a minimum surface area rim which minimizes the surface area available for bubbles from the headspace gas or aspirated air to adhere to minimize the probability of an air bubble reentering the lumen of the dropper tip when dispensing a first or subsequent drop. A re-usable cap effects sealing on a surface other than the minimum-surface dispensing rim so that repeated capping and uncapping will not degrade the minimum-surface rim and its ability to dispense precise drop volumes over its operating life. Additionally, the cap applies a sealing force to the fitment to maintain the fitment in its sealed relationship with the container.

The present invention advantageously provides a dropper tip and dropper tip bottle combination which provides accurate drop-to-drop volumetric delivery with minimum deviations and minimizes the probability of the introduction of an air or gas bubble into the lumen of the dispensing tip when dispensing a first or subsequent drop.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 2 is the view of the dropper tip of FIG. 1 inserted into an exemplary resilient squeeze bottle in the vertically inverted position;

FIG. 3 is a greatly enlarged view of the dropper tip end of FIGS. 1 and 2 illustrating the minimum-surface liquid contact area at the remote end of the dropper tip;

FIG. 4 is a greatly enlarged view of the interior configuration of the fitment of the dropper tip of FIGS. 1 and 2 showing the minimum-surface configuration at the entry port of the lumen in the inverted orientation;

DESCRIPTION OF THE PREFERRED EMBODIMENT

Figure 1:
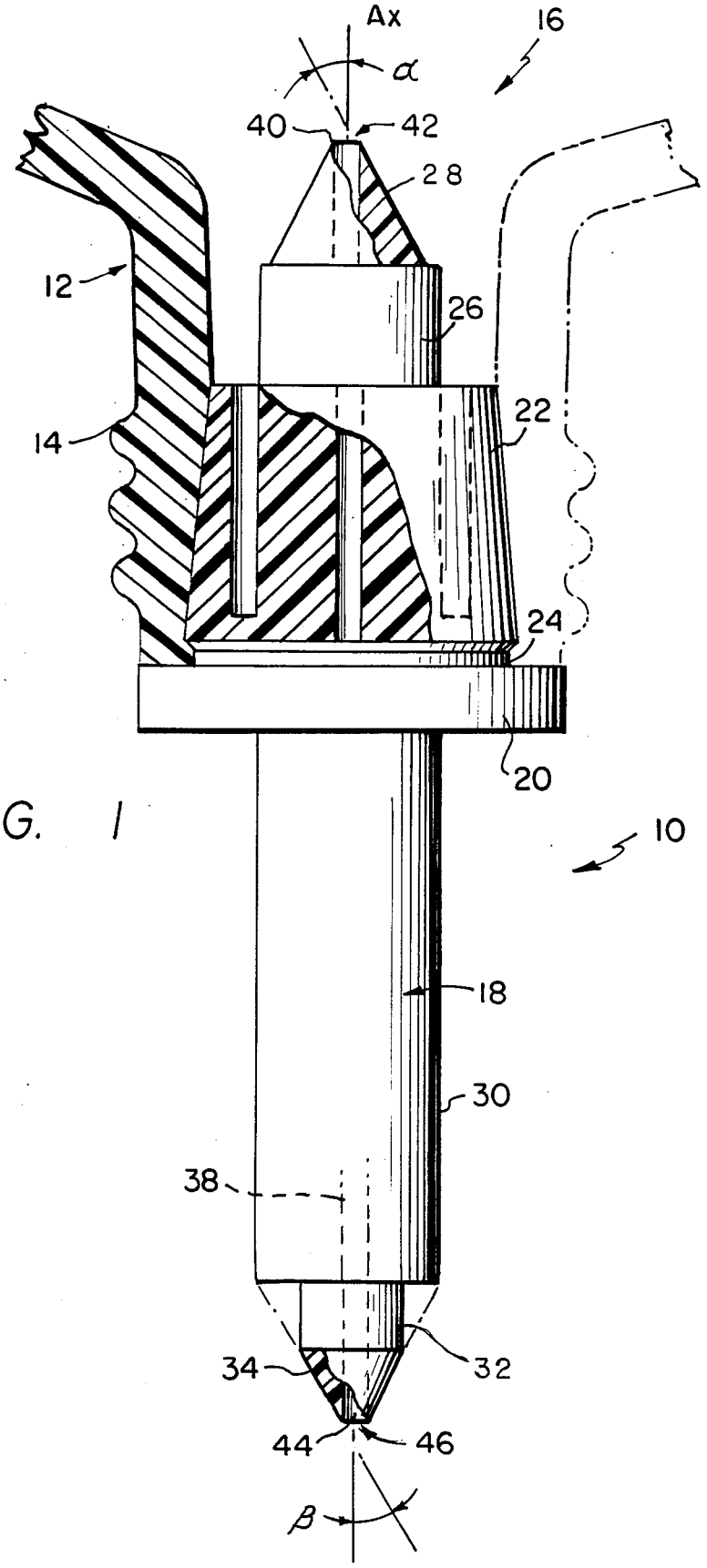
FIG. 1 is an enlarged elevational view of a dropper tip in accordance with the present invention shown in partial cross section and in its inverted position.

An exemplary dropper tip in accordance with the present invention is shown in enlarged, partial cross-section and in an inverted position in FIG. 1 and is designated generally therein by the reference character 10. The dropper tip 10 is formed as a body of revolution about a longitudinally extending axis $A_x$ and is designed to be installed into the neck (unnumbered) of a resilient, plastic "squeeze" container or bottle 12 (partially illustrated in FIG. 1 in solid and broken line illustration) which may include external threads 14 for accepting a cap (not shown). The dropper tip 10 includes a fitment 16 that is inserted in a press-fit relationship into the neck of the bottle 12 and a dispensing stem 18. Preferably, the dropper tip 10 is molded as a unitary component from a plastic, such as polyethylene, that is not adversely affected by the fluid to be dispensed from the bottle 12.

The fitment 16 includes a circular flange 20 having an outside diameter consistent with that of the neck of the bottle 12 with a sealing skirt 22 that extends from the flange 20 toward the interior of the bottle 12. The skirt 22 is undercut by a reduced-diameter annular groove 24 adjacent the flange 20 that preferably engages an inwardly extending sealing rim (unnumbered) formed on the interior of the neck of the bottle 12 to assist in maintaining the dropper tip 10 in its assembled position. The major portion of the skirt 22 is thin-walled (i.e., about 0.030 inches) and converges slightly from the flange 20 toward the interior of the bottle 12 and resiliently engages the interior surfaces of the neck in a line-to-line or interference fit. The skirt 22 extends a sufficient distance along the axis $A_x$ to engage the interior surfaces of the neck and can extend somewhat further into the interior of the bottle 12. An interior stem 26 extends from the flange 20 and is configured as a cylinder about the axis $A_x$ with a diameter less than that of the skirt 22 to define an annular space (unnumbered) between the skirt 22 and the interior stem 26. If desired, the annular space can be eliminated to provide a solid fitment configuration. An entry cone 28 is formed at the interior end of the stem 26 and provided with a half-angle $\alpha$ of about 30° to provide, as explained below, a minimum-area surface that discourages the aggregation or adhesion of air or other gas bubbles that could adversely affect the drop-to-drop volume of the dispensed fluid. It has been found the half-angle $\alpha$ can range between about 15° and 60° and still provide a desirably low drop-to-drop variation. The interior stem 26 extends sufficiently into the interior of the bottle 12 so that the narrow end of the entry cone 28 is not in the neck of the bottle 12. In the preferred embodiment, the interior stem 26 extends 0.375 inches from the flange 20.

The dispensing stem 18 is configured as a first cylinder 30 formed about the axis $A_x$ and which extends from the flange 20 and a second, reduced-diameter cylinder 32. In general, the dispensing stem 18 extends between 0.250 and 0.700 inches from the flange 20 with a 0.500 inch dimension preferred. An exit cone 34 terminates the remote end of the dispensing stem 18 and is formed with a half-angle $\beta$ of about 30° to provide, as explained below, a minimum-area surface that discourages the formation of undersized or oversized liquid drops at the exit cone 34 and thus minimizes drop-to-drop volumetric variations. As in the case of the entry cone 28, the half-angle $\beta$ can range between 15° and 60°. If desired, the cylinder 32 portion can be eliminated with the entire end of the dispensing stem 18 formed as a frusto-cone, as indicated by the dotted lines. A co-axially formed bore or lumen 38 extends throughout the length of the dropper tip 10 along the axis $A_x$ from the entry cone 28 to the exit cone 34 to define a circular rim 40 and entry port 42 at the interior end of the entry cone 28 and a circular rim 44 and exit port 46 at the remote end of the exit cone 34. In a preferred embodiment, for dispensing 12 microliter drops, the lumen 38 has a diameter of about 0.025 inches at the exit port 42. While the lumen 38 has been shown in the drawing as a constant diameter bore, as can be appreciated, the lumen 38 need not be a constant-diameter along its entire length.

An exemplary fluid-containing, resilient squeeze bottle 12 is shown in FIG. 2 in a vertical, inverted position. In the inverted position, the headspace gas rises to the liquid/gas interface above the liquid; any headspace gas that does not rise to the liquid/gas interface, as explained below, will not adversely affect the drop dispensing function. In order to dispense a drop, the user slowly squeezes the bottle 12 (as represented by the arrows F and F') while observing the fluid at the exit port 46 collect and form into a drop and then separated from the exit port 46 at the remote end of the exit cone 34.

The exit cone 34 and its exit port 46 provide a minimum-surface liquid-contact area for drop formation to assure minimum drop-to-drop volumetric variations. As shown in the enlarged view of FIG. 3, the dispensed liquid forms into a drop D (dotted line illustration) at the exit port 46 with the drop D adhering by surface tension about the circular rim 44 of the exit port 46 with the conical configuration providing a consistent minimum-surface area contact with the dispensed fluid. Accordingly, the exit cone 34 configuration provides a minimum-surface liquid-contact area to provide a minimum drop-to-drop volume variation. The minimum-surface liquid-contact area concept can be appreciated in the context of a flat surface surrounding the exit port 46, as exemplified by the surface 34' (dotted line illustration). As can be appreciated, the other than minimum-surface liquid-contact area exemplified by the surface 34' increases the opportunity for variations in wetted-surface characteristics and the attendant variations in first-drop volume and subsequent drop-to-drop volume.

In addition to providing minimum-surface liquid-contact contact during drop formation, the present invention addresses the problem of air or other gaseous bubbles in the interior of the bottle 12. As discussed above, when the bottle 12 is initially inverted, not all of the headspace gas may rise to the liquid/gas interface. Additionally, when the squeezing forces F and F' on the bottle 12 are relaxed while the bottle 12 is in its inverted or inclined position, air is aspirated into the interior of the bottle 12. The entry port 42, as explained below, has a desirable minimum surface configuration that encourages the aspirated air to rise to the liquid/gas interface and minimize the opportunity for the air to form bubbles that adhere to the entry cone 28. As shown in the enlarged view of FIG. 4, the entry cone 28 provides a minimum-surface area to minimize the possibility of any aspirated bubbles adhering to a surface at or immediately adjacent the entry port 42 and thus minimize the probability of any bubbles entering the entry port 42 and adversely affecting the first-drop volume and any subsequent drop volumes. In addition, the stem 26 is sufficiently long to extend out of the neck of the bottle 12 so that the entry port 42 is exposed directly to the liquid to be dispensed rather than as in an 'in-the-neck' configuration. This entry port configuration assures that any headspace gas that does not rise to the liquid/-gas interface in the inverted bottle 12 will not adhere to surfaces at or immediately adjacent the entry port 42 to adversely affect the drop dispensing function.

The concept of the minimum-surface area contact for the adhesion of air or other gas bubbles can be appreciated by considering an entry port 42 defined by a circular hole in a planar surface (as represented by the dotted line 28' in FIG. 4). In such a situation, ample surface area is present immediately adjacent and about the entry port 42 to permit the adhesion of headspace gas or aspirated air bubbles that can enter the entry port 42 and lumen 38 when one or more drops D are dispensed.

Figure 5:
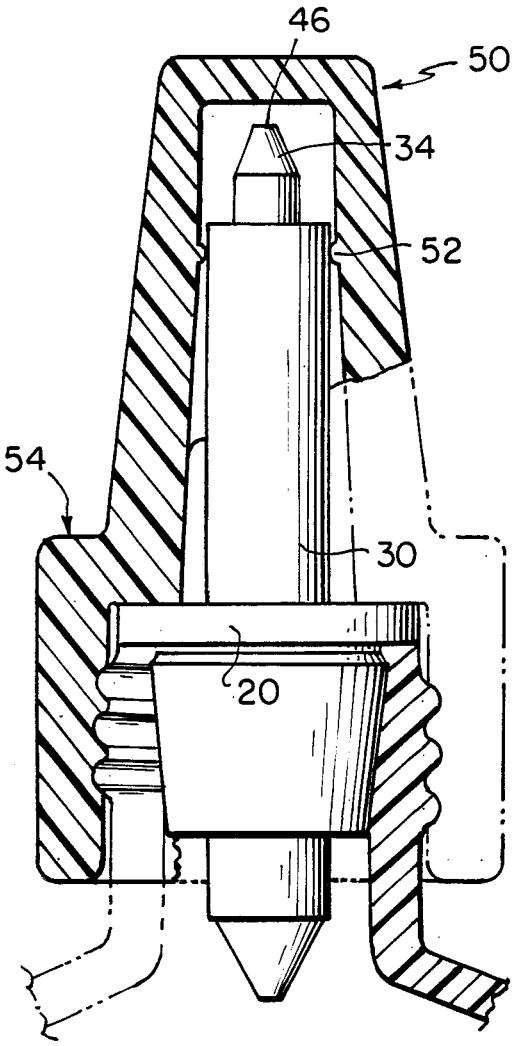
FIG. 5 is a view, in partial cross-section, of the dispensing end of the dropper tip and a sealing cap in their assembled position.
Figure 6:
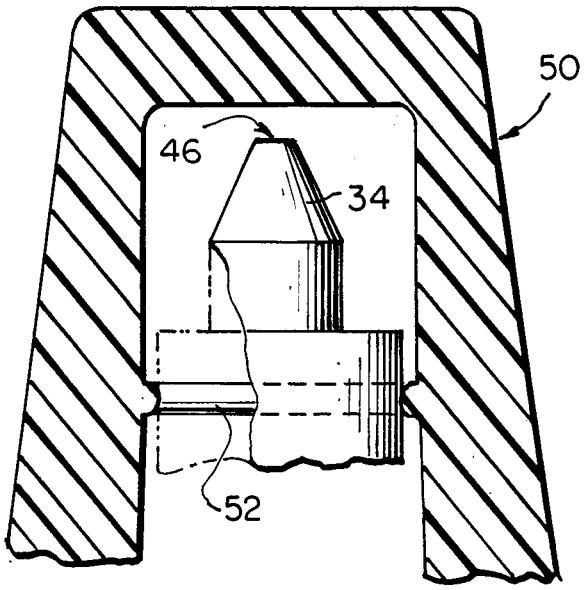
FIG. 6 is an enlarged view of the sealing feature of the cap of FIG. 5.

In order to provide a re-usable closure or cap for the dropper tip 10, it is important that the exit port 46, its surrounding rim 44, and the exit cone 34 immediately adjacent the rim 44 not be subjected to any sealing forces that could adversely affect the minimum-surface area contact conditions during the dispensing life of the dropper tip 10. In this regard, an overcap or closure is provided that effects a fluid-tight seal on a surface of the dropper tip 10 other than the exit port 46, its surrounding rim 44, or surfaces on the exit cone 34 immediately adjacent the exit port 46. More specifically and as shown in FIG. 5 and the enlarged detail of FIG. 6, a cap 50 is formed with an interior surface (unnumbered) and a inwardly facing peripheral rim 52 that is designed to fit over and engage the peripheral surface of the cylinder 30 that defines the dispensing stem 18. The rim 52, which may have a semi-circular profile, is designed to provide a resilient sliding and rotatable relationship relative to the cylinder 30 portion of the stem 18 so that the cap 50 can be screwed into its sealed position as well as conveniently removed. The cap 50 provides sufficient interior clearances so that sealing is effected on surfaces other than the exit cone 34 and the exit port 46. In this manner, the critical surfaces of the exit cone 34, the rim 44, and the exit port 46 which foster the minimum-surface liquid-contact area relationship with the dispensed fluid during drop formation, as discussed above, are preserved during the normal dispensing life of the dropper tip 10. The cap 50 also includes a base portion 54 that engages the flange 20 of the fitment 16 and applies a force to urge and maintain the fitment 16 in the neck of the bottle 12. If desired, the cap 50 can be provided as a two-piece combination, i.e., a first cap that effects sealing of the exit port 46 with an inwardly directed rim and a second, overcap that secures the first cap in place and engages the external threads of the bottle 12 to apply a sealing force to the fitment 16.

The present invention advantageously provides a dropper tip configuration that desirably provides precise first-drop volumes and minimizes subsequent drop-to-drop volume variations in dispensed drops using a dropper tip that can be inexpensively manufactured in large quantities for use in disposable test and analysis kits.

As will be apparent to those skilled in the art, various changes and modifications may be made to the illustrated precision microliter drop dispenser of the present invention without departing from the spirit and scope of the invention as determined in the appended claims and their legal equivalent.

I claim:

1. A dropper tip for the drop-wise dispensing of a liquid in drop volumes of less than 20 μl volumes from a container, comprising:

a dispensing stem having a cylindrical lumen therethrough formed along an axis from a liquid entry port at one end to an exit port at the other end, the lumen defined by a surface of revolution about the axis; and a fitment intermediate the ends of said dispensing stem for engaging a neck of a container to position one portion of said dispensing stem and said entry port in the interior of the liquid container and to position the remaining portion of the dispensing stem and said exit port exteriorly of the container;

said entry port defined by a frusto-conical surface formed about the axis, the lumen extending along the axis through said frusto-conical surface to define a circular rim at the intersection of said frusto-conical surface and said surface of revolution, the circular rim having a minimum contact surface at said entry port to minimize surface area for the adhesion of bubbles at or adjacent to said entry port.

2. The dropper tip of claim 1, wherein the half-angle of said frusto-conical surface is between 15° and 60°.

3. A dropper tip for the drop-wise dispensing of a liquid in drop volumes of less than 20 μl from a container, comprising:

a dispensing stem having a cylindrical bore therethrough formed along an axis from a liquid entry port at one end to an exit port at the other end, the bore defined by a surface of revolution about the axis; and a fitment intermediate the ends of said dispensing stem for engaging a neck of a container to position one portion of said dispensing stem and said entry port in the interior of the liquid container and to position the remaining portion of the dispensing stem and said exit port exteriorly of the container;

said exit port defined by a frusto-conical surface formed about the axis, the bore extending along the axis through the frusto-conical surface to define a circular rim at the intersection of said frusto-conical surface and said surface of revolution, the circular rim having a minimum liquid-contact surface area at said exit port;

said entry port defined by a second frusto-conical surface formed about the axis, the bore extending along the axis through said second frusto-conical surface to define a second circular rim at the intersection of said second frusto-conical surface and said surface of revolution, the second circular rim having a minimum contact surface at said entry port to minimize surface area for the adhesion of bubbles at or adjacent said entry port.

4. The dropper tip of claim 3, wherein said remaining portion of said dispensing stem is formed as a first cylinder and a second, reduced-diameter cylinder about the axis, said first-mentioned frusto-conical surface at the remote end of said second cylinder.

5. The dropper tip of claim 4, further comprising:

means for capping said exit port of said dispensing stem by sealing engagement with a surface other than said first-mentioned circular rim, said capping means effecting sealing on a surface of said first-mentioned cylinder.

6. The dropper tip of claim 3, wherein the half-angle of said frusto-conical surfaces is between 15° and 60°.

7. The dropper tip of claim 3, wherein the half-angle of said frusto-conical surfaces is approximately 30°.

8. The dropper tip of claim 3, further comprising:

means for capping said exit port of said dispensing stem by sealing engagement with a surface other than said first-mentioned circular rim.

9. The dropper tip of claim 3, wherein said fitment further comprises:

a circular flange extending radially outward of said dispensing stem at a position intermediate the ends of said stem and having an axially extending skirt about the periphery of said flange to effect engagement with the neck of a liquid container.

10. A dropper tip for the drop-wise dispensing of a liquid in drop volumes of less than 20 μl from a container, comprising:

a dispensing stem having a bore therethrough formed along an axis from a liquid entry port at one end to an exit port at the other end, the bore defined by a surface of revolution about the axis, said entry and exit ports defined, respectively, by an entry circular rim and an exit circular rim, said entry circular rim formed at the intersection of said surface of revolution and an entry-end frusto-conical surface at the entry end and said exit circular rim formed at the intersection of said surface of revolution and an exit-end frusto-conical surface at the exit end, the circular rims each defining a minimum liquid-contact surface area; and a fitment intermediate the ends of said dispensing stem for engaging a neck of a container to position said entry port in the interior of the liquid container and position a portion of said dispensing stem and said exit port exteriorly of the container.

11. The dropper tip of claim 10, wherein the exterior portion said dispensing stem is formed as a first cylinder and a second, reduced-diameter cylinder about the axis.

12. The dropper tip of claim 11, further comprising:

means for capping the exit port of the dispensing stem by sealing engagement with a surface other than said exit circular rim at said exit port, said capping means effecting sealing on a surface of said first-mentioned cylinder.

13. The dropper tip of claim 12, wherein said capping means further comprises a sealing rim for engaging a peripheral surface of said first-mentioned cylinder to effect sealing.

14. The dropper tip of claim 12, wherein said capping means further comprises a base portion for urging said fitment into engagement with the neck portion of a container.

15. The dropper tip of claim 10, further comprising:

means for capping said exit port of the dispensing stem by sealing engagement with a surface other than said exit circular rim.

16. A drop dispensing bottle and tip for the drop-wise dispensing of a liquid in drop volumes of less than 20 μl from the bottle, comprising:

a container formed from a resilient material; and a dispensing stem having a cylindrical bore therethrough formed along an axis from a liquid entry port at one end to an exit port at the other end, the bore defined by a surface of revolution about the axis, said dispensing stem engaging a neck of said container to position one portion of said dispensing stem and said entry port in the interior of the liquid container and to position the remaining portion of the dispensing stem and said exit port exteriorly of the container;

said entry port defined by a frusto-conical surface formed about the axis, the bore extending along the axis through said frusto-conical surface to define a circular rim at the intersection of said frusto-conical surface and said surface of revolution, the circular rim having a minimum contact surface at said entry port to minimize surface area for the adhesion of bubbles at or adjacent said entry port.

17. The dropper tip of claim 16, wherein the half-angle of said frusto-conical surface is between 15° and 60°.

18. The dropper tip of claim 16, wherein the half-angle of said frusto-conical surface is approximately 30°.

* * * * *